US006093011A

United States Patent [19]

Kosman

[11] Patent Number: 6,093,011

[45] Date of Patent: Jul. 25, 2000

[54] APPARATUS FOR MANUFACTURING GREEN BRICKS FOR THE BRICK MANUFACTURING INDUSTRY

[75] Inventor: Wilhelmus Jacobus Maria Kosman, Da Groesbeek, Netherlands

[73] Assignee: Beheermaatschappij de Boer Nijmegen B.V., Nijmegen, Netherlands

[21] Appl. No.: 09/206,856

[22] Filed: Dec. 8, 1998

[30] Foreign Application Priority Data

Nov. 12, 1998 [NL] Netherlands ..... 1010536

[51] Int. Cl.[7] ..... B28B 5/02

[52] U.S. Cl. ..... 425/253; 425/220; 425/357; 425/424; 425/425; 425/431; 425/434

[58] Field of Search ..... 425/220, 253, 425/254, 357, 424, 425, 431, 434, 452

[56] References Cited

U.S. PATENT DOCUMENTS

| | | | |
|---|---|---|---|
| 1,782,413 | 11/1930 | Dietrichs | 425/431 |
| 2,545,366 | 3/1951 | Mandryl | 425/220 |
| 4,652,228 | 3/1987 | Cousin | 425/452 |
| 5,612,064 | 3/1997 | Kosman | 425/255 |

FOREIGN PATENT DOCUMENTS

| | | |
|---|---|---|
| 0680812 | 11/1995 | European Pat. Off. . |
| 3546191 | 7/1987 | Germany . |
| 9400663 | 12/1995 | Netherlands . |

*Primary Examiner*—James P. Mackey
*Attorney, Agent, or Firm*—Webb Ziesenheim Logsdon Orkin & Hanson, P.C.

[57] ABSTRACT

Disclosed is an apparatus for manufacturing green bricks from clay for the brick manufacturing industry. The apparatus includes a circulating conveyor carrying mould containers combined to mould container parts, a reservoir for clay arranged above the mould containers, a mechanism for carrying clay out of the reservoir into the mould containers, a mechanism for pressing and trimming clay in the mould containers, a mechanism for supplying and placing take-off plates for the green bricks and a mechanism for discharging green bricks released from the mould containers. The apparatus further includes a mechanism for moving the mould container parts filled with green bricks such that a protruding edge is formed on at least one side of the green bricks.

11 Claims, 5 Drawing Sheets

APPARATUS FOR MANUFACTURING GREEN BRICKS FOR THE BRICK MANUFACTURING INDUSTRY

BACKGROUND OF THE INVENTION

1. Field of the Invention

The invention relates to an apparatus for manufacturing green bricks from clay for the brick manufacturing industry.

2. Description of the Prior Art

An apparatus for manufacturing green bricks from clay can include a circulating conveyor carrying mould containers combined to mould container parts, a reservoir for clay arranged above the mould containers, means for carrying clay out of the reservoir into the mould containers, means for pressing and trimming clay in the mould containers, means for supplying and placing take-off plates for the green bricks and means for discharging green bricks released from the mould containers. Such an apparatus is known in the field and is for instance described in Netherlands patent 1000186 of applicant. The known apparatus is extremely suitable for automated production of large numbers or green bricks for the brick manufacturing industry. The bricks fired from these green bricks have a substantially smooth, uniform appearance.

A recent demand has developed on the market for bricks which appear as if they have been manufactured according to traditional methods.

The present invention has for its object to adapt the known apparatus such that it can produce in automated manner large numbers of green bricks with a traditional appearance.

SUMMARY OF THE INVENTION

For this purpose the apparatus according to the invention has the feature that the apparatus further comprises means for moving the mould container parts filled with green bricks such that a protruding edge is formed on at least one side of the green bricks.

The bricks fired from the green bricks produced sing the apparatus according to the invention impart beautiful shadow effects to the wall into which they have been built when the sun shines thereon. This aesthetic effect is an important commercial advantage.

The edge-forming means are preferably adapted to move the mould container parts repeatedly for a certain period. Repetition a number of times, for instance three times, is found in practice to be sufficient to obtain the intended effect.

In a practical preferred embodiment the edge-forming means are adapted to move the mould container parts substantially transversely of the transporting direction.

In a further preferred embodiment the edge-forming means comprise a frame which is adapted to engage individually on a mould container part. This preferred embodiment has the significant advantage that the edge-forming means can act on one mould container part while another mould container part undergoes another operation and is for instance filled with clay. The edge-forming means can therefore be added to the known apparatus without this affecting the production time.

In yet another preferred embodiment the frame spans the mould container part and is provided on both sides with stop members which are situated during operation at the location of the side walls of the mould container part. An exceptionally compact embodiment of the invention is hereby realized which utilizes the available space economically and can be arranged without difficulty on the known apparatus.

In order to prevent unnecessary damage to the mould container parts, these latter are provided on their side walls with stop surfaces, preferably of plastic. In preference the stop members of the frame of the edge-forming means are also provided with these, preferably plastic, stop surfaces.

BRIEF DESCRIPTION OF THE DRAWINGS

The invention is described in more detail hereinbelow with reference to the drawing in which.

DETAILED DESCRIPTION OF THE PREFERRED EMBODIMENTS

Figure 1:
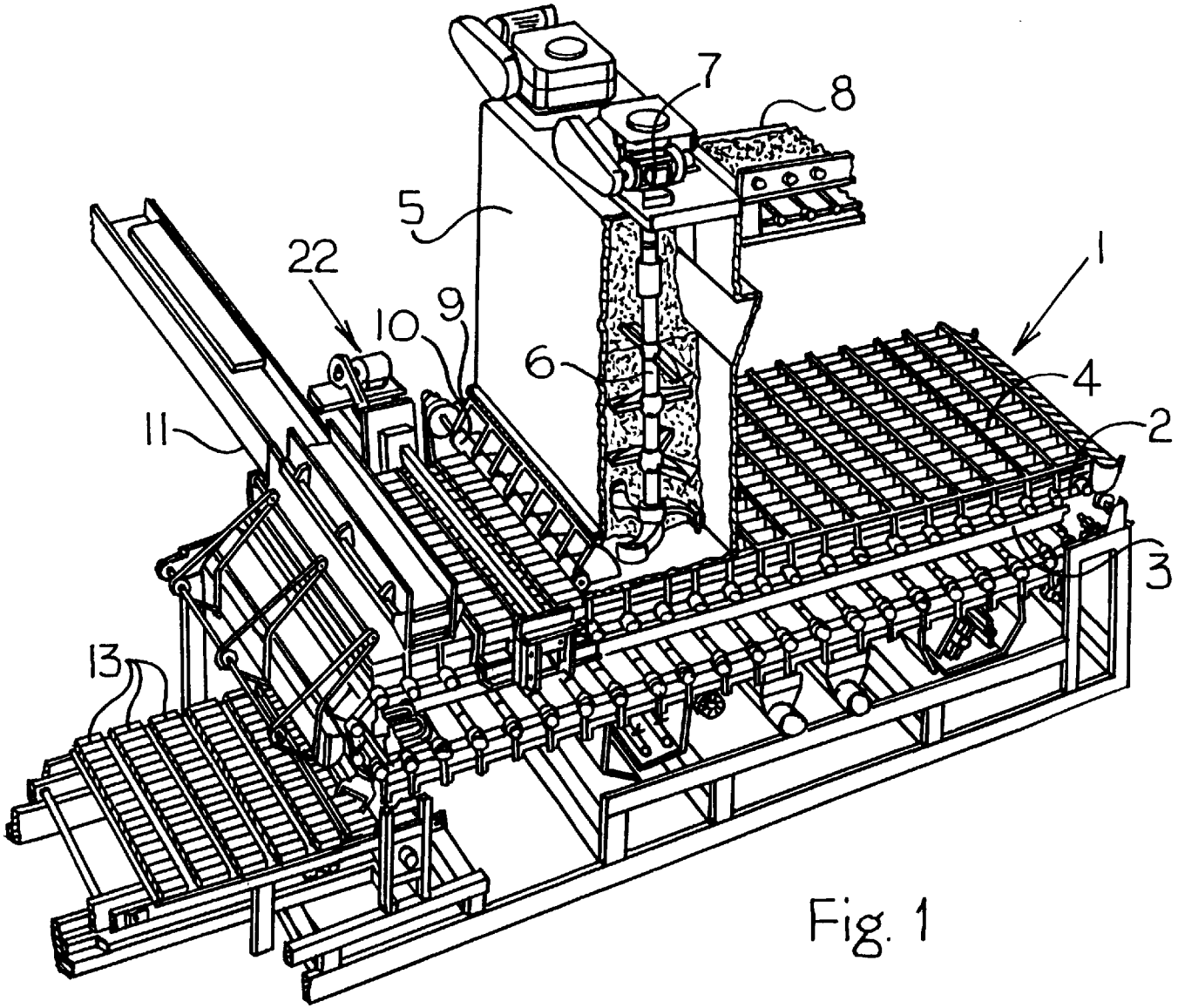
FIG. 1 shows schematically a preferred embodiment of the apparatus according to the invention.

Like components are provided in the figures with like reference numerals.

FIG. 1 shows a preferred embodiment of an apparatus for manufacturing green bricks for the brick manufacturing industry according to the invention. Apparatus 1 comprises a conveyor 3. Mould containers combined to a unit are placed in the form of a mould container part 4 on the conveyor. The mould container parts fit closely against each other, Placed above the mould containers is a reservoir 5 for clay which is kept in continuous movement by an agitator 6 which is driven by the electric motor 7. Clay is supplied to reservoir 5 by a circulating conveyor 8. The clay is carried out of reservoir 5 into the mould containers and then pressed down by pressing device 9 which is pivotable on shaft 10. The excess clay is also trimmed using means which are not shown in the figures drawn. The device 11 carries take-off plates 12 onto a mould container part such that, after turning over of the mould container part, the green bricks 13 come to lie on the plates after being released from the mould containers.

Edge-forming means 22 are arranged between device 9 and device 11. The edge-forming means move each mould container part 4 such that a protruding edge forms on the upper side of the green bricks received therein.

Figure 2:
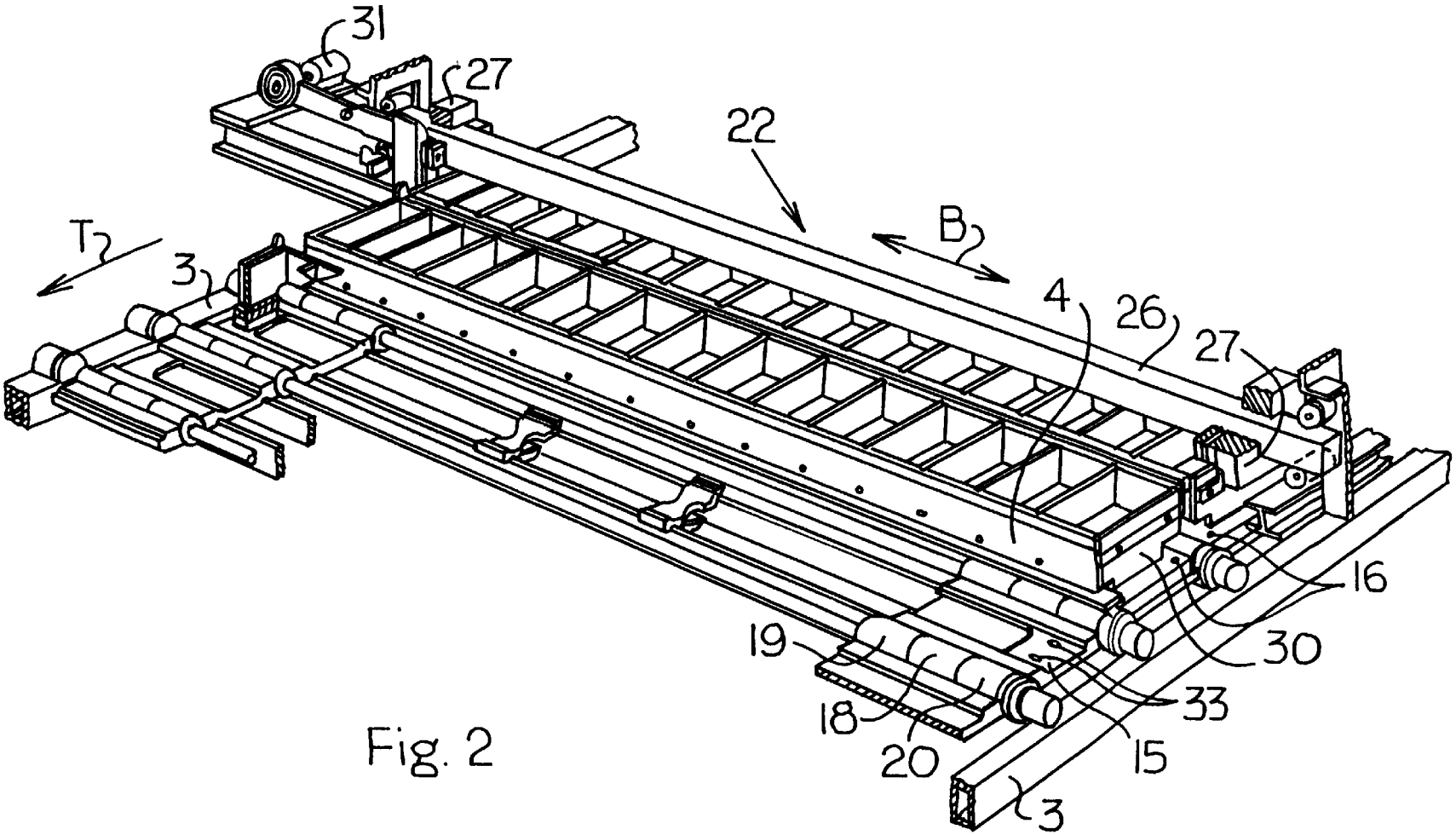
FIG. 2 shows in more detail a perspective view of a part of the apparatus of FIG. 1 with the edge-forming means therein.

FIG. 2 shows in more detail the part of apparatus 1 comprising edge-forming means 22. In the shown preferred embodiment, the edge-forming means 22 comprise a frame 26 which spans mould container part 4. Frame 26 is provided on either side with stop members 27 which are situated at the position of side walls 30 of the mould container part. The distance between stop members 27 is greater than the length of the mould container part. Frame 26 can be moved reciprocally by means of drive 31 as designated by means of arrow B. In preference the direction of movement B of frame 26 lies substantially transversely of the transporting direction T of conveyor 3. By moving frame 26 repeatedly the stop members 27 strike alternately against the side walls 30 of the mould container part 4 which is spanned at that moment by frame 26. As a result the relevant mould container part is as it were shaken back and forth, whereby the green bricks 13 situated during operation in mould containers 21 of mould container part 4 rise a certain distance in the mould containers. This results in the intended edge forming on the upper side of each green brick.

Drive 31 is preferably an eccentric drive which can subject heavy components to a smooth movement owing to a good distribution of forces. The eccentric drive can for instance be adjusted such that the moment a stop member comes up against one of the side walls of a mould container part, the maximum force is exerted by the drive on this mould container part.

Each mould container part 4 is coupled with some clearance to conveyor 3 in the direction of movement B. In the shown preferred embodiment each mould container part is even disengageably coupled to an associated chain part 15 of chain conveyor 3. The coupling of both parts takes place using the bolt-nut connections 16, 17 respectively. Bolt holes 33 are given an oval form in order to create the necessary clearance. Chain part 15 of chain conveyor 3 comprises ears 18, 19, 20 which serve as links of the chain conveyor. It is noted that instead of a chain conveyor many other conveyors known in the field can be used.

Figure 3:
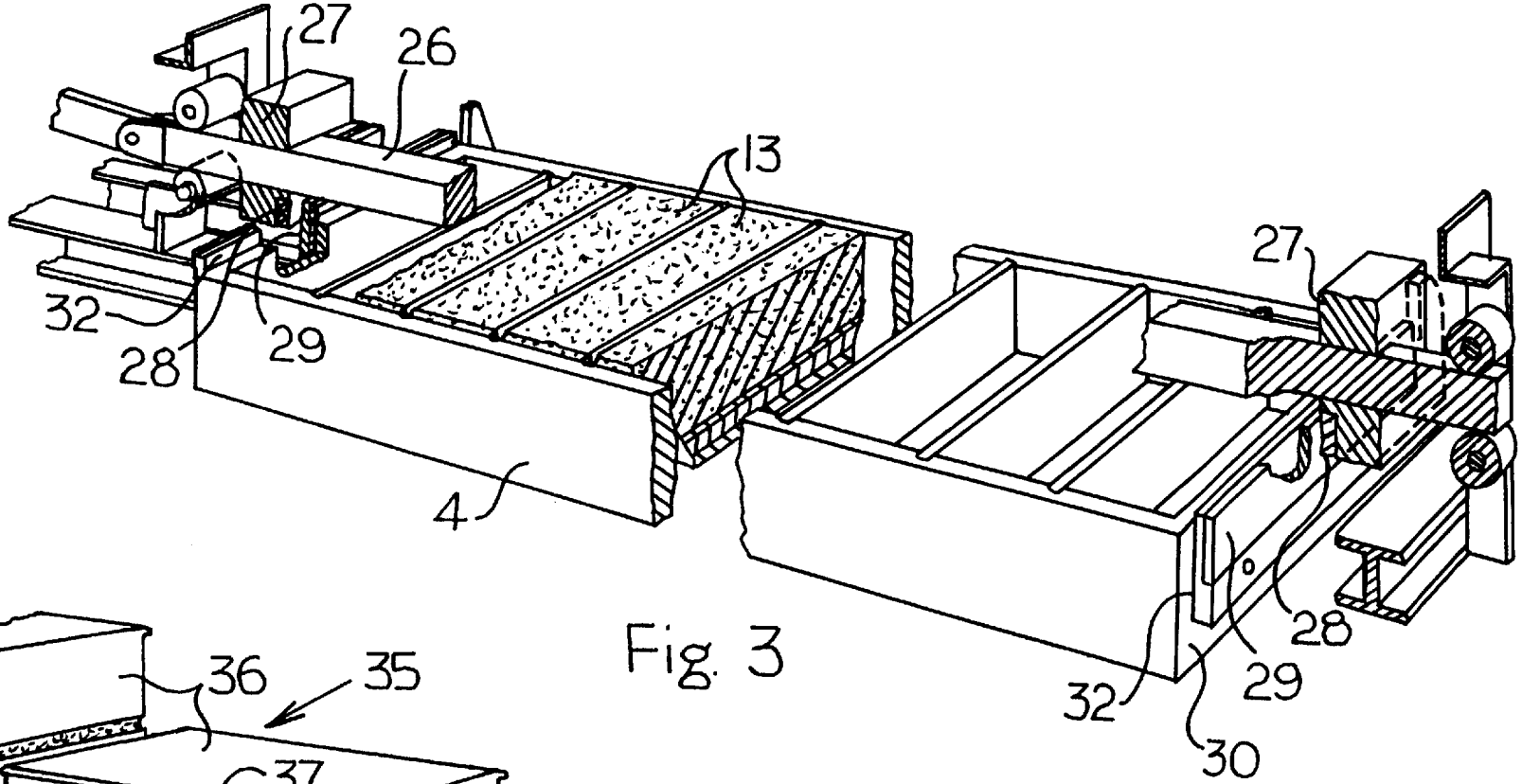
FIG. 3 shows the edge-forming means of FIG. 2 in even more detail.

FIG. 3 shows edge-forming means 22 in even more detail. So as to prevent damage, stop members 27 are provided with stop surfaces 28 and corresponding stop surfaces 29 are arranged on side walls 30 of the mould container parts. The stop surfaces are preferably of plastic.

Each mould container part 4 is further provided at both sides with spacer members 32 on walls 30. These spacer members protrude slightly above the mould container part itself, so that take-off plates 12 can rest thereon without damaging the edge which has just been formed on green bricks 13. It has been found in practice that the form of green bricks 13, including the edge, is retained after the mould container part has been turned over.

Figure 4:
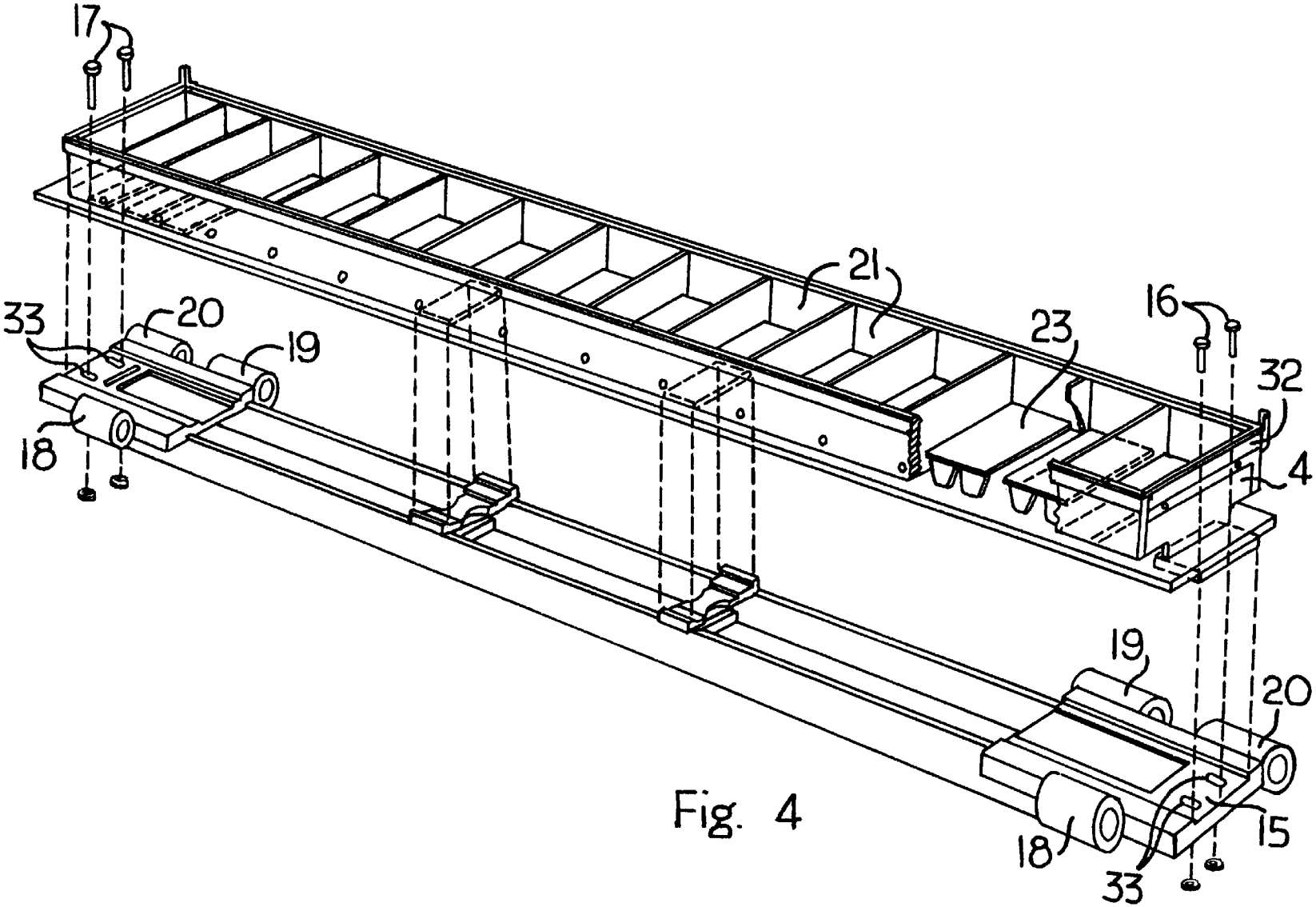
FIG. 4 is a perspective view of a first preferred embodiment of a mould container part which is suitable for use in the apparatus according to the invention.
Figure 5:
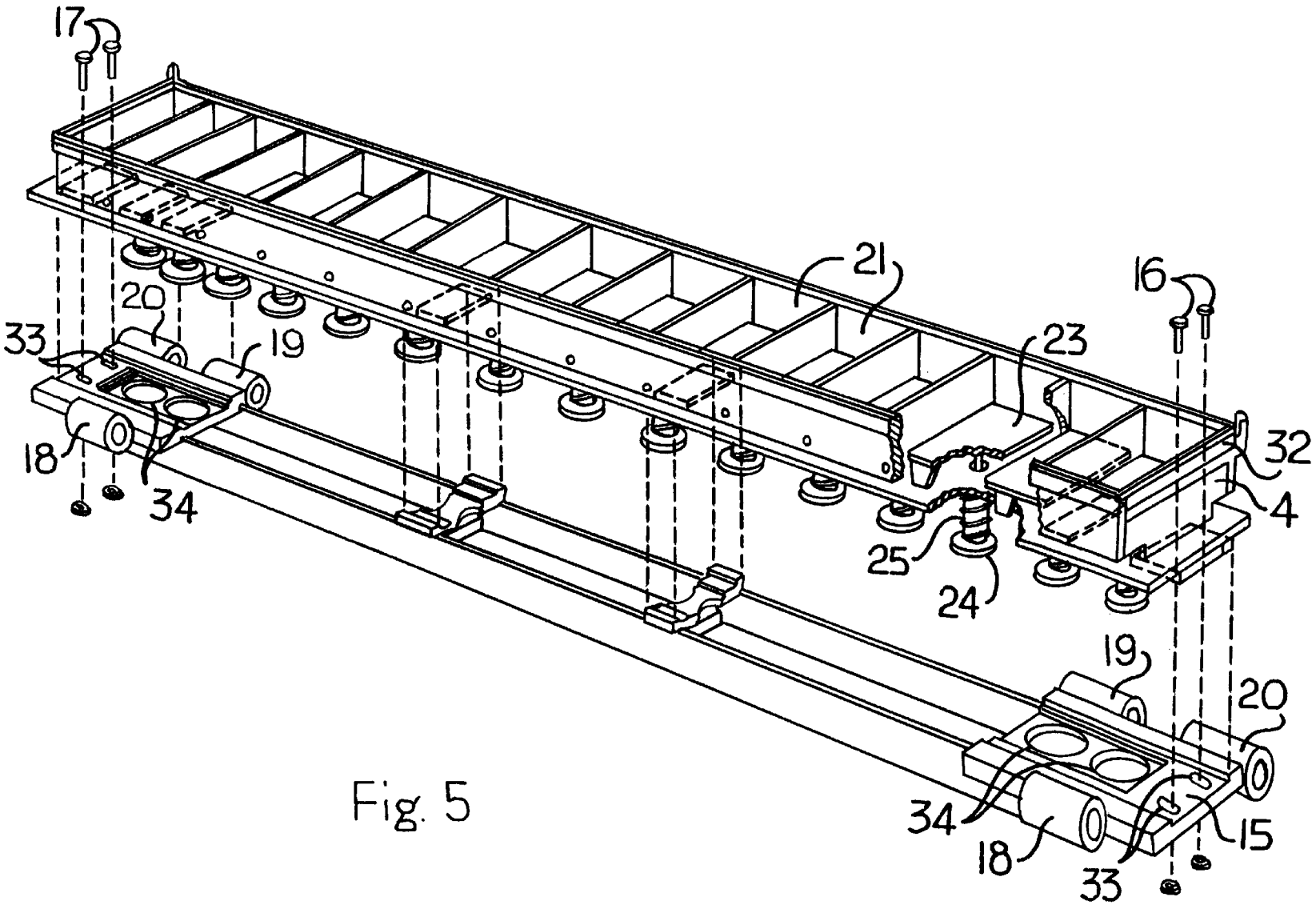
FIG. 5 is a perspective view of a second preferred embodiment of a mould container part.

FIG. 4 shows a first preferred embodiment of a mould container part 4 and a chain part 15 in uncoupled situation. The different mould containers 21 are combined to a unit on mould container part 4. It is noted that the use of edge-forming means 22 has the further important advantage that additional means for releasing the green bricks from the mould containers are no longer necessary. An example of such releasing means known in the field are bottoms 23 displaceable by means of ejectors 24 such as are arranged in the second preferred embodiment shown in FIG. 5. This ejector lies under bias of spring 25 which centres the ejector such that no separate guiding is necessary in chain part 15. Ejector 24 is operated by a per se known driving device (not shown) during release of the green bricks. These releasing means are used by applicant in a number of their apparatuses and are the subject of the patent 1000186 in the name of applicant. FIG. 5 shows how with some modifications the mould container parts and chain parts of the known apparatus can be used in combination with the edge-forming means according to the invention. The modifications relate to enlargement of the holes 34 for ejectors 24 such that mould container part 4 is coupled to chain part 15 with some clearance in the direction of movement B. Roles 34 can for instance be oval for this purpose. It is noted that the multi-part mould container part as described in applicant's non-prepublished patent application 1007600 can also be made suitable in like manner for use in an apparatus provided with the edge-forming means according to the invention.

Figure 6:
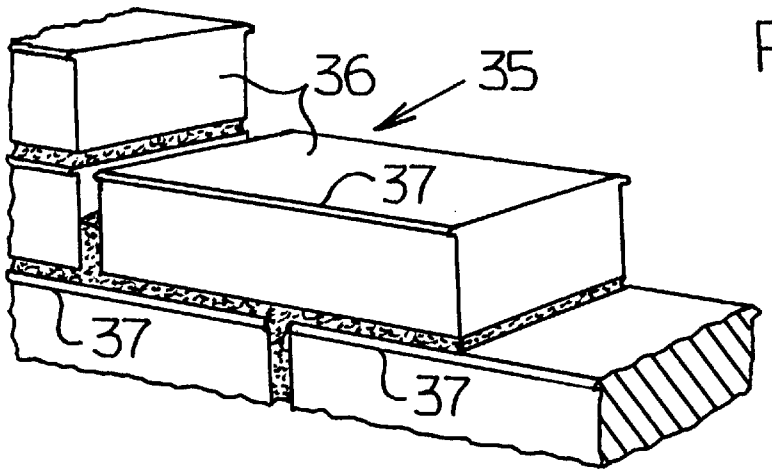
FIG. 6 shows schematically a part of a wall which has been built using bricks provided with an edge and fired from the green bricks manufactured using the apparatus according to the invention.

Finally, FIG. 6 shows a wall 35 which is built from bricks 36 provided with a protruding edge 37 by using the apparatus according to the invention. It is possible to imagine that an exceptional shadow effect can be caused by sunlight incident upon the wall.

The present invention is of course not limited to the described and illustrated embodiment but comprises all embodiments which fall within the scope of the appended claims.

What is claimed is:

1. An apparatus for manufacturing green bricks from clay for the brick manufacturing industry, said apparatus comprising a circulating conveyor carrying mould containers combined to mould container parts, a reservoir for clay arranged above the mould containers, means for carrying clay out of the reservoir into the mould containers, means for pressing and trimming clay in the mould containers, means for supplying and placing take-off plates for the green bricks and means for discharging green bricks released from the mould containers, wherein the apparatus further includes means for moving the mould container parts filled with green bricks such that a protruding edge is formed on at least one side of the green bricks.

2. The apparatus as claimed in claim 1, wherein the edge-forming means are adapted to move the mould container parts repeatedly for a certain period.

3. The apparatus as claimed in claim 1, wherein the edge-forming means are adapted to move the mould container parts substantially transversely of the transporting direction.

4. The apparatus as claimed in claim 1, wherein the edge-forming means includes a frame which is adapted to engage individually on a mould container part.

5. The apparatus as claimed in claim 4, wherein the frame spans the mould container part and is provided on both sides with stop members which are situated during operation at the location of the side walls of the mould container part.

6. The apparatus as claimed in claim 5, wherein the stop members are provided with stop surfaces.

7. The apparatus as claimed in claim 5, wherein the mould container parts are provided on their side walls with stop surfaces.

8. The apparatus as claimed in claim 4, wherein the edge-forming means includes an eccentric drive for the frame.

9. The apparatus as claimed in claim 1, wherein each mould container part is provided with a number of spacer members for supporting the take-off plates at a distance above the green bricks.

10. The apparatus as claimed in claim 1, wherein the mould container parts are fixed movably onto the conveyor with some clearance in the direction of movement.

11. The apparatus as claimed in claim 10, wherein the conveyor is a chain conveyor and the mould container parts are coupled with some clearance in the direction of movement to a chain part connectable to the chain.

* * * * *

UNITED STATES PATENT AND TRADEMARK OFFICE

CERTIFICATE OF CORRECTION

PATENT NO. : 6,093,011

DATED : July 25, 2000

INVENTOR(S) : Wilhelmus J.M. Kosman

It is certified that error appears in the above-identified patent and that said Letters Patent is hereby corrected as shown below:

Column 1 Line 40 "sing" should read --using--.

Column 2 Line 48 after "figures" delete --drawn--.

Column 3 Line 65 "Roles 34" should read --Holes 34--.

Signed and Sealed this

Tenth Day of April, 2001

*Attest:*

Nicholas P. Godici

NICHOLAS P. GODICI

*Attesting Officer*

*Acting Director of the United States Patent and Trademark Office*